US006663380B2

(12) United States Patent
Rabovitser et al.

(10) Patent No.: US 6,663,380 B2
(45) Date of Patent: Dec. 16, 2003

(54) METHOD AND APPARATUS FOR ADVANCED STAGED COMBUSTION UTILIZING FORCED INTERNAL RECIRCULATION

(75) Inventors: Iosif K. Rabovitser, Skokie, IL (US); Richard A. Knight, Brookfield, IL (US); David F. Cygan, Villa Park, IL (US); Serguei Nester, Elk Grove Village, IL (US); Hamid A. Abbasi, Naperville, IL (US)

(73) Assignee: Gas Technology Institute, Des Plaines, IL (US)

( * ) Notice: Subject to any disclaimer, the term of this patent is extended or adjusted under 35 U.S.C. 154(b) by 69 days.

(21) Appl. No.: 09/946,444

(22) Filed: Sep. 5, 2001

(65) Prior Publication Data

US 2003/0054303 A1 Mar. 20, 2003

(51) Int. Cl.[7] ..... F23M 3/00; F23C 5/00

(52) U.S. Cl. ..... 431/9; 431/116; 431/174

(58) Field of Search ..... 431/9, 10, 116, 431/160, 174

(56) References Cited

U.S. PATENT DOCUMENTS

| | | | | | |
|---|---|---|---|---|---|
| 4,004,875 | A | | 1/1977 | Zink et al. | |
| 4,395,223 | A | | 7/1983 | Okigami et al. | |
| 4,496,306 | A | * | 1/1985 | Okigami et al. | 431/8 |
| 4,575,332 | A | | 3/1986 | Oppenberg et al. | |
| 4,629,413 | A | | 12/1986 | Michelson et al. | |
| 4,673,350 | A | * | 6/1987 | Collier | 431/353 |
| 4,705,022 | A | * | 11/1987 | Collier | 126/91 A |
| 5,044,932 | A | | 9/1991 | Martin et al. | |
| 5,241,949 | A | * | 9/1993 | Collier | 126/91 A |
| 5,350,293 | A | | 9/1994 | Khinkis et al. | |
| 5,573,391 | A | | 11/1996 | Benson et al. | |
| 5,636,977 | A | | 6/1997 | Benson et al. | |
| 6,024,083 | A | * | 2/2000 | Smirnov | 126/91 A |
| 6,089,855 | A | * | 7/2000 | Becker et al. | 431/9 |

* cited by examiner

*Primary Examiner*—Alfred Basichas
(74) *Attorney, Agent, or Firm*—Mark E. Fejer

(57) ABSTRACT

A method and apparatus for combustion of a fuel in which a first-stage fuel and a first-stage oxidant are introduced into a combustion chamber and ignited, forming a primary combustion zone. At least about 5% of the total heat output produced by combustion of the first-stage fuel and the first-stage oxidant is removed from the primary combustion zone, forming cooled first-stage combustion products. A portion of the cooled first-stage combustion products from a downstream region of the primary combustion zone is recirculated to an upstream region of primary combustion zone. A second-stage fuel is introduced into the combustion chamber downstream of the primary combustion zone and ignited, forming a secondary combustion zone. At least about 5% of the heat from the secondary combustion zone is removed. In accordance with one embodiment, a third-stage oxidant is introduced into the combustion chamber downstream of the secondary combustion zone, forming a tertiary combustion zone.

20 Claims, 4 Drawing Sheets

METHOD AND APPARATUS FOR ADVANCED STAGED COMBUSTION UTILIZING FORCED INTERNAL RECIRCULATION

The U.S. Government has a paid-up license in this invention and the right in limited circumstances to require the patent owner to license others on reasonable terms as provided for by the terms of Contract No. DE-FC07-95ID13333 awarded by the U.S. Department of Energy.

BACKGROUND OF THE INVENTION

1. Field of the Invention

This invention relates to a method and apparatus for staged combustion of a fossil fuel which has the capability of reducing the formation of nitrogen oxides ($NO_x$) while simultaneously providing substantially complete combustion at low excess oxidant, that is, an overall stoichiometric ratio that does not exceed 1.25, although higher or lower ratios may be employed, if desired. More particularly, this invention relates to a burner for boilers and other process heating equipment such as fluid heaters, furnaces, radiant tubes, and kilns which are fueled by gaseous or liquid fuels, in which the fuel and/or oxidant are introduced in stages, and combustion products are substantially recirculated within the combustion zone.

2. Description of Prior Art

Conventional combustion of fossil fuels produces elevated temperatures which promote complex chemical reactions between oxygen and nitrogen, forming various oxides of nitrogen as byproducts of the combustion process. These oxides, containing nitrogen in different oxidation states, generally are grouped together under the single designation of $NO_x$. Concern over the role of $NO_x$ and other combustion byproducts, such as sulfur oxides, carbon monoxide, total hydrocarbons and carbon dioxide, in "acid rain" and other environmental problems has generated considerable interest in reducing the formation of these environmentally harmful byproducts of combustion.

Known methods of combustion for reducing $NO_x$ emissions from combustion processes include flue gas recirculation and staged combustion. U.S. Pat. No. 4,004,875 teaches a low $NO_x$ burner for combustion of liquid and gaseous fuels in which the combustion area is divided into at least two stages and combustion products are recirculated, cooled and reintroduced into the primary combustion zone, resulting in a reduction of $NO_x$ emissions. The secondary combustion air is introduced into a secondary combustion zone downstream of the primary combustion zone in an amount sufficient to complete combustion therein. Fuel and primary combustion air are introduced into a primary combustion zone formed by a burner tile which provides a high temperature environment for the fuel and air mixture to promote combustion. Except for the opening into the secondary combustion zone, the tile is completely surrounded by a steel enclosure forming an annular space around the tile. Thus, as fuel and air are injected into the primary combustion zone, part of the partially combusted fuel and air is recirculated around the outside of the tile in the annular space between the tile and steel enclosure and back into the upstream end of the primary combustion zone. U.S. Pat. No. 5,350,293 teaches a combustion process and apparatus employing air staging in which at least two combustion zones, a primary combustion zone and a secondary combustion zone disposed downstream of the primary combustion zone, are formed. In addition, at least a portion of the products of combustion generated in the primary combustion zone are recirculated from a downstream region of the primary combustion zone to an upstream region thereof. U.S. Pat. No. 5,573,391 and U.S. Pat. No. 5,636,977 teach a multi-stage combustion process and apparatus in which internal recirculation of combustion products is carried out only in the secondary combustion zone and a portion of the primary, fuel-lean air/fuel mixture is introduced into the secondary combustion zone. See also U.S. Pat. No. 4,629,413 which teaches a low $NO_x$ burner utilizing staged combustion in which a mixture of primary combustion air and fuel is introduced into a primary combustion chamber and secondary combustion air is introduced into the combustion chamber in a manner such that the mixing of the secondary combustion air with the flame generated by the mixture of fuel and primary combustion air is delayed; U.S. Pat. No. 5,044,932 which also teaches a process and apparatus for reducing the $NO_x$ content of the flue gas effluent from a furnace in which cooled flue gases are internally recirculated from the downstream end of the combustion chamber into the upstream end of the combustion chamber where it undergoes reaction with the flame generated by the fuel and air introduced into the upstream end of the combustion chamber; U.S. Pat. No. 4,575,332 which teaches staged combustion in a swirl combustor with forced annular recycle of flue gases to the upstream end of the primary combustion zone; and U.S. Pat. No. 4,395,223 which teaches staged combustion with excess air introduced into the primary combustion zone with additional fuel being introduced into the secondary combustion zone.

It is also known that, in addition to limiting the oxygen available in a combustion process for formation of $NO_x$ emissions, $NO_x$ emissions may also be controlled by maintaining the temperature in the combustion zone below the temperature required for formation of significant amounts of $NO_x$, about 2600° F. Cooling of the products of combustion is suggested by U.S. Pat. No. 4,004,875 discussed hereinabove. However, by recirculating the cooled partial combustion products from the downstream of the primary combustion zone to the upstream end of the primary combustion zone, any heat removed from the primary combustion zone as a result of cooling is reintroduced into the secondary combustion zone, resulting in no net heat removal from the combustion process. Consequently, the temperatures in the primary and secondary combustion zones are not maintained below the level required for significant $NO_x$ formation.

In spite of numerous advances toward reducing $NO_x$ emissions from boilers and other process heating equipment, such as fluid heaters, furnaces, radiant tubes and kilns, which are fueled by gaseous or liquid carbonaceous or hydrocarbon fuels, a substantial amount of $NO_x$ continues to be produced by such heating equipment. As a result, there continues to be a need for further reducing the amount of $NO_x$ produced by such heating equipment, particularly if future standards restricting $NO_x$ emissions are to be met.

It is also apparent that the number of boilers and process heating apparatuses producing $NO_x$ emissions is very large and that replacement of these apparatuses with more up-to-date equipment as a means for reducing $NO_x$ emissions is not practical. As a result, proposed solutions for reducing $NO_x$ emissions must be able to address issues relating to the age and physical condition of the boilers and process heating equipment, such as the lack of gas-tight seals between various portions thereof which may result in the undesirable intake of air from around the heating equipment. For boilers and process heating equipment which lack a gas-tight seal between the combustion zone and convective pass, of which tangent-tube boilers are a typical example, combustion products from the primary combustion zone can leak into the convective pass. In addition, proposed solutions should be suitable for retrofitting to the boilers and process heating equipment, regardless of the physical condition of the tube walls.

As previously stated, combustion processes and apparatuses in which oxidant—typically air, oxygen, or oxygen-enriched air—is introduced into the processes and apparatuses in two or more stages are well known as means for reducing $NO_x$ emissions. However, in oxidant staging systems applied to boilers and process heating equipment lacking gas-tight seals between the combustion zone and the convective pass as previously discussed, the combustion products from the primary combustion zone that leak into the convective pass may contain high levels of CO, which can result in unacceptably high CO in the stack.

SUMMARY OF THE INVENTION

Accordingly, it is one object of this invention to provide a method and apparatus for combustion of fossil fuels which is capable of reducing $NO_x$ emissions compared to conventional methods and apparatuses.

It is another object of this invention to provide an apparatus for combustion of fossil fuels which is suitable for retrofitting to conventional boilers and process heating equipment.

These and other objects of this invention are addressed by a combustion apparatus comprising at least one combustion chamber wall forming at least one burner opening and enclosing a combustion chamber, and at least one multi-stage fuel/multi-stage oxidant burner having a fuel and oxidant inlet end and a fuel and oxidant outlet end attached to the at least one combustion chamber wall. At least a portion of the fuel and oxidant outlet end of the burner extends through the at least one burner opening into the combustion chamber.

The at least one multi-stage fuel/multi-stage oxidant burner comprises a first-stage plenum chamber wall enclosing a first-stage plenum chamber and forming a first-stage inlet for a first-stage fuel and a first-stage oxidant and a first-stage outlet for the first-stage fuel and the first-stage oxidant. The first-stage outlet is in fluid communication with the at least one burner opening. An end wall is disposed within the first-stage outlet having a periphery in contact with the first-stage plenum chamber wall and forming at least one first-stage nozzle opening and at least one second-stage nozzle opening. The at least one first-stage nozzle opening provides a fluid communication between the combustion chamber and the first-stage plenum chamber. A second-stage plenum chamber wall encloses a second-stage plenum and forms a second-stage inlet for a second-stage fuel and a second-stage oxidant and a second-stage outlet for the second-stage fuel and the second-stage oxidant. At least a portion of the second-stage plenum chamber is disposed within the first-stage plenum chamber and extends through the end wall, thereby providing fluid communication between the second-stage outlet and the combustion chamber.

In the method for combustion of a fossil fuel in accordance with one embodiment of this invention, a first-stage fuel and a first-stage oxidant are introduced into a combustion chamber and ignited, forming a primary combustion zone comprising first-stage combustion products. At least about 5% of the total heat output produced by combustion of the first-stage fuel and first-stage oxidant is removed from the primary combustion zone, forming cooled first-stage combustion products. A portion of the cooled first-stage combustion products is recirculated from a downstream region of the primary combustion zone to an upstream region of the primary combustion zone. A second-stage fuel is introduced into the combustion chamber downstream of the primary combustion zone, forming a secondary combustion zone and igniting the second-stage fuel, forming second-stage combustion products. At least about 5% of the heat from the secondary combustion zone is also removed. In accordance with one preferred embodiment of this invention, the first stage of oxidant comprises more than a stoichiometric requirement for complete combustion of the first-stage fuel.

BRIEF DESCRIPTION OF THE DRAWINGS

These and other objects and features of this invention will be better understood from the following detailed description taken in conjunction with the drawings wherein.

DETAILED DESCRIPTION OF PRESENTLY PREFERRED EMBODIMENTS

As used herein, the term "stoichiometric ratio" is defined as the oxidant-to-fuel ratio divided by the oxidant-to-fuel ratio at stoichiometric conditions.

The apparatus of this invention is a burner for boilers and other process heating equipment, such as fluid heaters, furnaces, radiant tubes, and kilns, which are fueled by gaseous and/or liquid fossil fuels, which is designed to reduce the formation of $NO_x$ emission from said boilers and process heating equipment simultaneous with complete combustion of the fuel at low excess oxidant, that is overall stoichiometric ratios preferably not exceeding about 1.25, although higher or lower ratios can be used, if desired. This design results in lower levels of $NO_x$ in the flue gases than comparable burner designs that employ only oxidant staging, that is where fuel is introduced into the burner only in a single stage. Additionally, when compared to oxidant staging designs, this invention is advantageous for retrofit to boilers and process heating equipment which lack a gas-tight seal between the combustion zone and the convective pass. That is, implementation of this invention maintains levels of CO in the stack which are acceptable in spite of the existence of leaks between the combustion zone and the convective pass.

The combustion apparatus of this invention comprises a combustion chamber having a primary combustion zone and a secondary combustion zone and at least one burner comprising primary and secondary stages into which the fuel and oxidant are introduced, either premixed, partially premixed or nozzle-mixed. A plurality of first-stage nozzles are provided in an array, preferably a circular array, around the central axis of the burner. Forced internal recirculation is employed to recirculate products of combustion to the region of flame ignition in the primary combustion zone or in both the primary and secondary combustion zones. To provide recirculation of the products of combustion, a fixed component of the burner, referred to herein as a recirculation sleeve, which provides recirculation of the combustion products generated in the primary combustion zone induced by the kinetic energy of the primary combustion zone oxidant-fuel jets is provided. In addition, the recirculation sleeve also promotes stabilization of the flame and provides heat transfer by radiation from the primary combustion zone to the cooled walls of the boiler or other process heating equipment, thereby reducing the flame temperature and, consequently, reducing $NO_x$ formation. As described hereinbelow, the burner apparatus may contain a plurality of recirculation sleeves.

Figure 1:
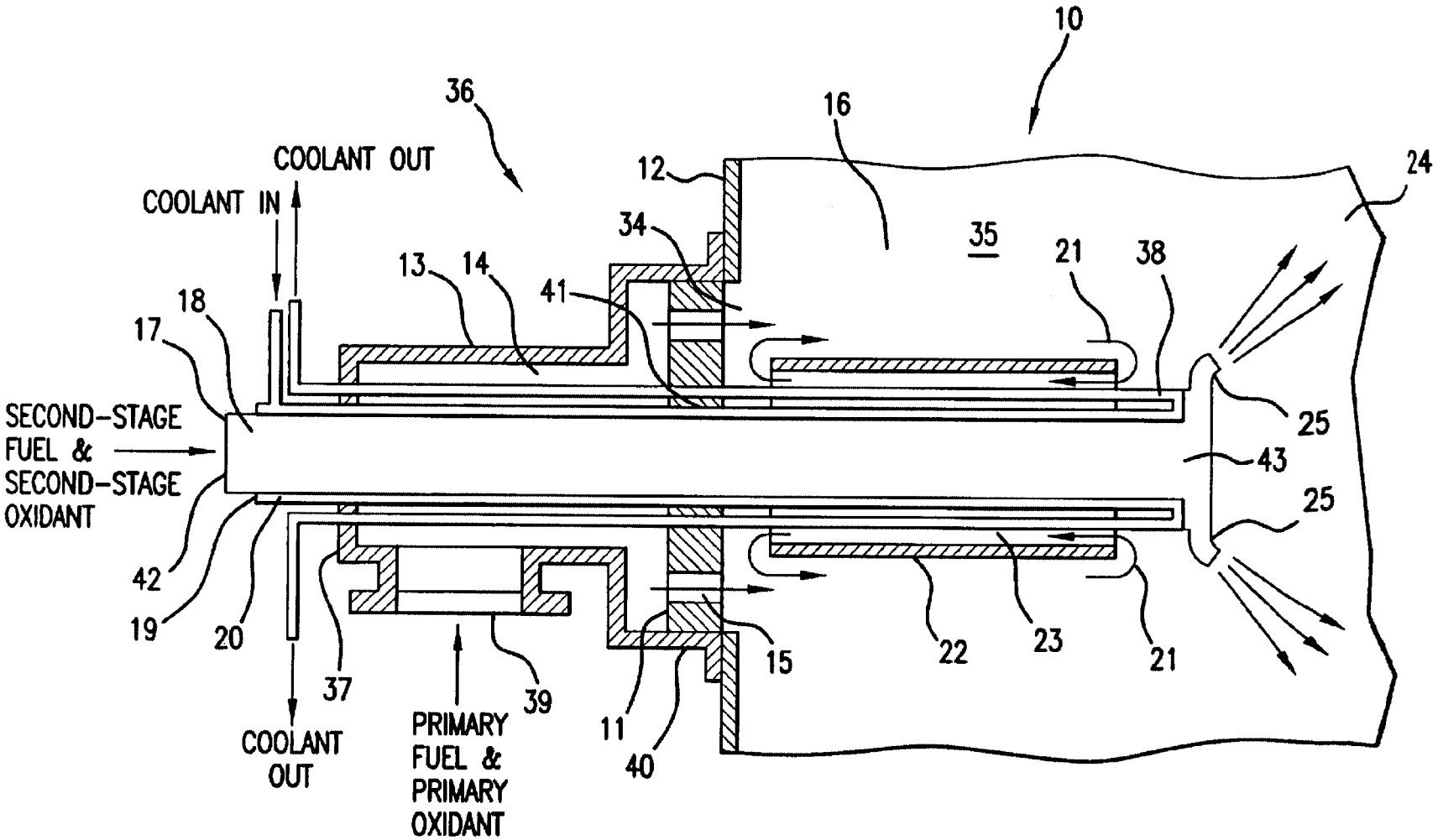
FIG. 1 is a partial cross-sectional lateral view of a combustion apparatus in accordance with one embodiment of this invention in which second-stage fuel and oxidant are premixed external to the burner and introduced into the combustion chamber at a point downstream of the primary combustion zone and a primary combustion zone recirculation means.

FIG. 1 shows an exemplary combustion apparatus in accordance with one embodiment of this invention. As shown, the combustion apparatus 10 comprises at least one combustion chamber wall 12 forming at least one burner opening 34 and enclosing combustion chamber 35. Attached to combustion chamber wall 12 is at least one multi-stage fuel/multi-stage oxidant burner 36 having a fuel/oxidant inlet end 37 and a fuel/oxidant outlet end 38, whereby at least a portion of fuel/oxidant outlet end 38 extends through said at least one burner opening 34 into combustion chamber 35.

Multi-stage fuel/multi-stage oxidant burner 36 comprises first-stage plenum chamber wall 13 enclosing first-stage plenum chamber 14 and forming a first-stage fuel/first-stage oxidant inlet 39 and a first-stage fuel/first-stage oxidant outlet 40, which first-stage fuel/first-stage oxidant outlet is in fluid communication with burner opening 34. Disposed within first-stage fuel/first-stage oxidant outlet 40 is end wall 11 having a periphery in contact with first-stage plenum chamber wall 13 and forming at least one first-stage nozzle opening 15, which provides fluid communication between combustion chamber 35 and first-stage plenum chamber 14, and a second-stage nozzle opening 41. Second-stage plenum chamber wall 17 encloses second-stage plenum chamber 18 and forms second-stage fuel/second-stage oxidant inlet 42 and second-stage fuel/second-stage oxidant outlet 43. At least a portion of second-stage plenum chamber 18 is disposed within first-stage plenum chamber 14 and extends through second-stage nozzle opening 41 of end wall 11 into combustion chamber 35, thereby providing a fluid communication between second-stage fuel/second-stage oxidant outlet 43 and combustion chamber 35. Disposed around at least a portion of the outer surface of second-stage plenum chamber wall 17 is second-stage cooling jacket wall 19 forming a second-stage cooling jacket 20 around and in contact with at least a portion of an outer surface of second-stage plenum chamber wall 17, thereby providing cooling of second-stage plenum chamber wall 17 as well as the contents of second-stage plenum chamber 18. The coolant circulated in second-stage cooling jacket 20 may be any fluid that provides the desired cooling. In accordance with one embodiment of this invention, the cooling fluid is selected from the group consisting of water, oil, air, nitrogen, carbon dioxide and flue gases.

Combustion chamber 35 comprises primary combustion zone 16 and secondary combustion zone 24 disposed downstream of primary combustion zone 16. The at least one multi-stage fuel/multi-stage oxidant burner 36 comprises recirculation means for recirculating products of combustion from a downstream region of primary combustion zone 16 to an upstream region of primary combustion zone 16 as denoted by arrows 21. In accordance with one preferred embodiment of this invention, said recirculation means comprises a recirculation wall 22, preferably in the shape of a hollow cylinder, disposed in combustion chamber 35 and surrounding at least a portion of second-stage plenum chamber 18. Recirculation wall or sleeve 22 is disposed in primary combustion zone 16 parallel to and at an axial distance from the axes of first-stage nozzle openings 15, thereby forming recirculation annulus 23 between recirculation wall or sleeve 22 and second-stage cooling jacket wall 19 disposed around second-stage plenum chamber wall 17. Without wishing to be bound by any particular theory or explanation of the mechanics of the recirculation of combustion products within primary combustion zone 16, it is believed that as a result of negative pressure generated in the upstream region of primary combustion zone 16 by the kinetic energy provided by the introduction of the first-stage fuel/first-stage oxidant mixture through first-stage nozzle openings 15, a portion of the partial products of combustion entering the downstream region of primary combustion zone 16 are recirculated through recirculation annulus 23, as indicated by arrows 21, and reintroduced through the upstream region of primary combustion zone 16 into primary combustion zone 16.

Connected to second-stage fuel/second-stage oxidant outlet of second-stage plenum chamber 18 are a plurality of second-stage nozzles 25 through which second-stage plenum chamber 18 is in fluid communication with secondary combustion zone 24. Second-stage nozzles are preferably disposed in an array surrounding the central axis of second-stage plenum chamber 18, which is perpendicular to end wall 11. A mixture of second-stage fuel and second-stage oxidant flows continuously into second-stage plenum chamber 18 and thereafter through second-stage nozzles 25 into secondary combustion zone 24 in which combustion of the second-stage fuel/second-stage oxidant mixture occurs.

Figure 2:
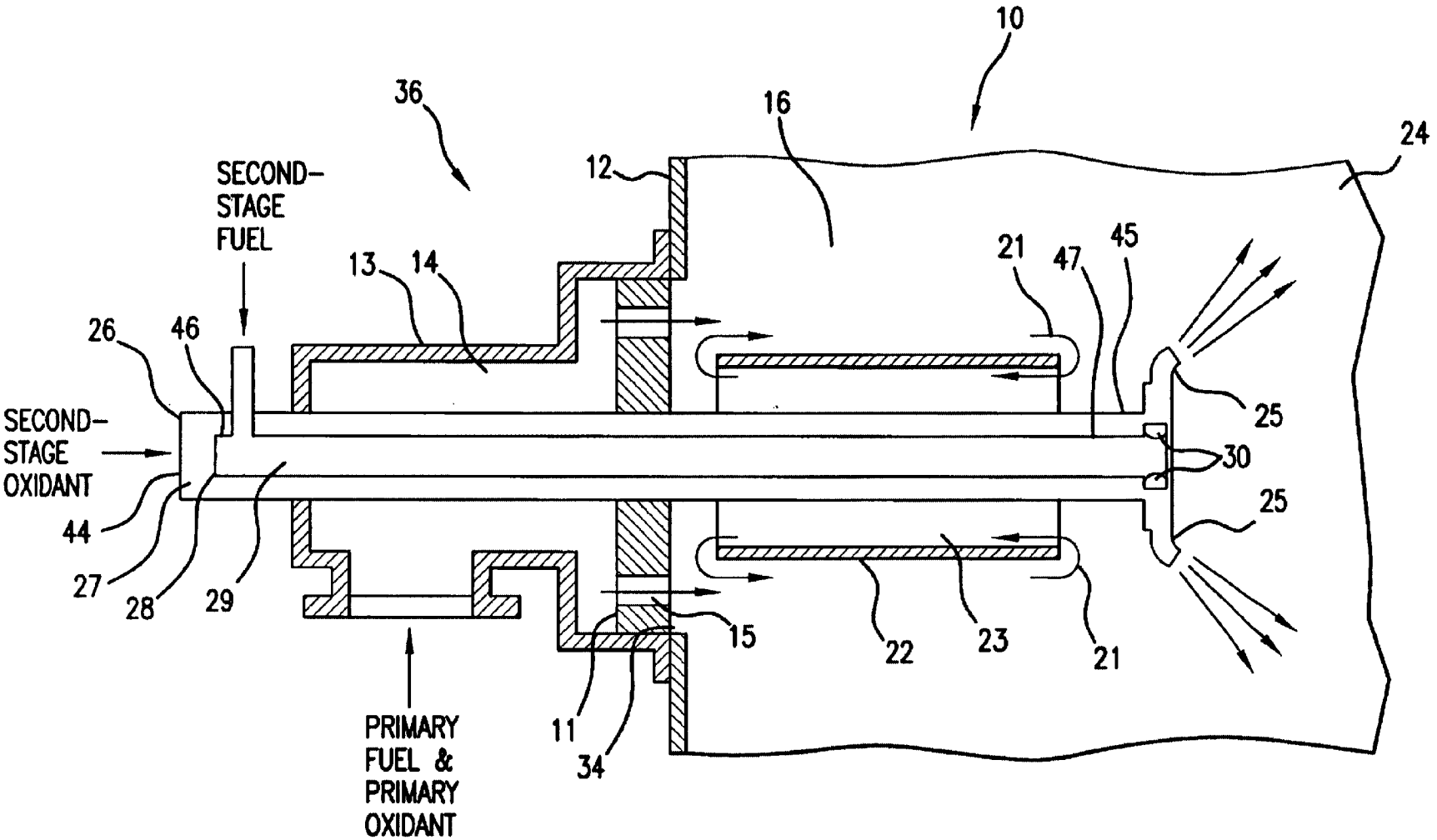
FIG. 2 is a partial cross-sectional lateral view of a combustion apparatus in accordance with another embodiment of this invention in which second-stage fuel and oxidant are not premixed, but rather mixed in the region where one or more second-stage fuel jets introduce second-stage fuel into a chamber containing flowing second-stage oxidant, resulting in partial mixing of the second-stage fuel and oxidant prior to entering the combustion chamber.

A combustion apparatus in accordance with another embodiment of this invention is shown in FIG. 2. As shown, the combustion apparatus 10 comprises at least one combustion chamber wall 12 forming at least one burner opening 34 and enclosing combustion chamber 35. Attached to combustion chamber wall 12 is at least one multi-stage fuel/multi-stage oxidant burner 36 having a fuel/oxidant inlet end 37 and a fuel/oxidant outlet end 38, whereby at least a portion of fuel/oxidant outlet end 38 extends through said at least one burner opening 34 into combustion chamber 35.

Multi-stage fuel/multi-stage oxidant burner 36 further comprises second-stage oxidant plenum chamber wall 26, which extends through end wall 11 perpendicular to the plane of end wall 11 and encloses second-stage oxidant plenum chamber 27. Second-stage oxidant plenum chamber 27 comprises second-stage oxidant inlet end 44 and second-stage oxidant outlet end 45. Multi-stage fuel/multi-stage oxidant burner 36 in accordance with the embodiment shown in FIG. 2 further comprises second-stage fuel plenum chamber wall 28 enclosing second-stage fuel plenum chamber 29, a portion of which is disposed within second-stage oxidant plenum chamber 27. Second-stage fuel plenum chamber comprises second-stage fuel inlet end 46 and second-stage fuel outlet end 47. During combustion, second-stage oxidant enters second-stage oxidant plenum chamber 27 at second-stage oxidant inlet end 44 and second-stage fuel enters second-stage fuel plenum chamber 29 at second-stage fuel inlet end 46. In accordance with the embodiment shown in FIG. 2, second-stage nozzles 25 are connected to second-stage oxidant outlet end 45 of second-stage oxidant plenum chamber 27 and second-stage fuel nozzles 30 are connected to second-stage fuel outlet end 47 of second-stage fuel plenum chamber 29. Second-stage fuel nozzles 30 are disposed upstream of second-stage nozzles 25 as a result of which second-stage fuel nozzles 30 are in direct fluid communication with second-stage oxidant plenum chamber 27. Both second-stage nozzles 25 and second-stage fuel nozzles 30 are disposed in an array about the central axis of multi-stage fuel/multi-stage oxidant burner 36, which is perpendicular to end wall 11 of combustion chamber 35. In operation, second-stage fuel flows through second-stage fuel nozzles 30 into second-stage oxidant plenum chamber 27 where it mixes with second-stage oxidant prior to flowing through second-stage nozzles 25 and into secondary combustion zone 24 in which combustion of the second-stage fuel/oxidant mixture occurs.

As in the embodiment shown in FIG. 2, multi-stage fuel/multi-stage oxidant burner 36 comprises recirculation means for recirculating products of combustion from a downstream region of primary combustion zone 16 to an upstream region of primary combustion zone 16 as denoted by arrows 21. In accordance with one preferred embodiment of this invention, said recirculation means comprises a recirculation wall 22, preferably in the shape of a hollow cylinder, disposed in combustion chamber 35 and surrounding at least a portion of second-stage oxidant plenum chamber 27. Recirculation wall or sleeve 22 is disposed in primary combustion zone 16 parallel to and at an axial distance from the axes of first-stage nozzle openings 15, thereby forming recirculation annulus 23 between recirculation wall or sleeve 22 and second-stage oxidant plenum chamber wall 26.

Figure 3:
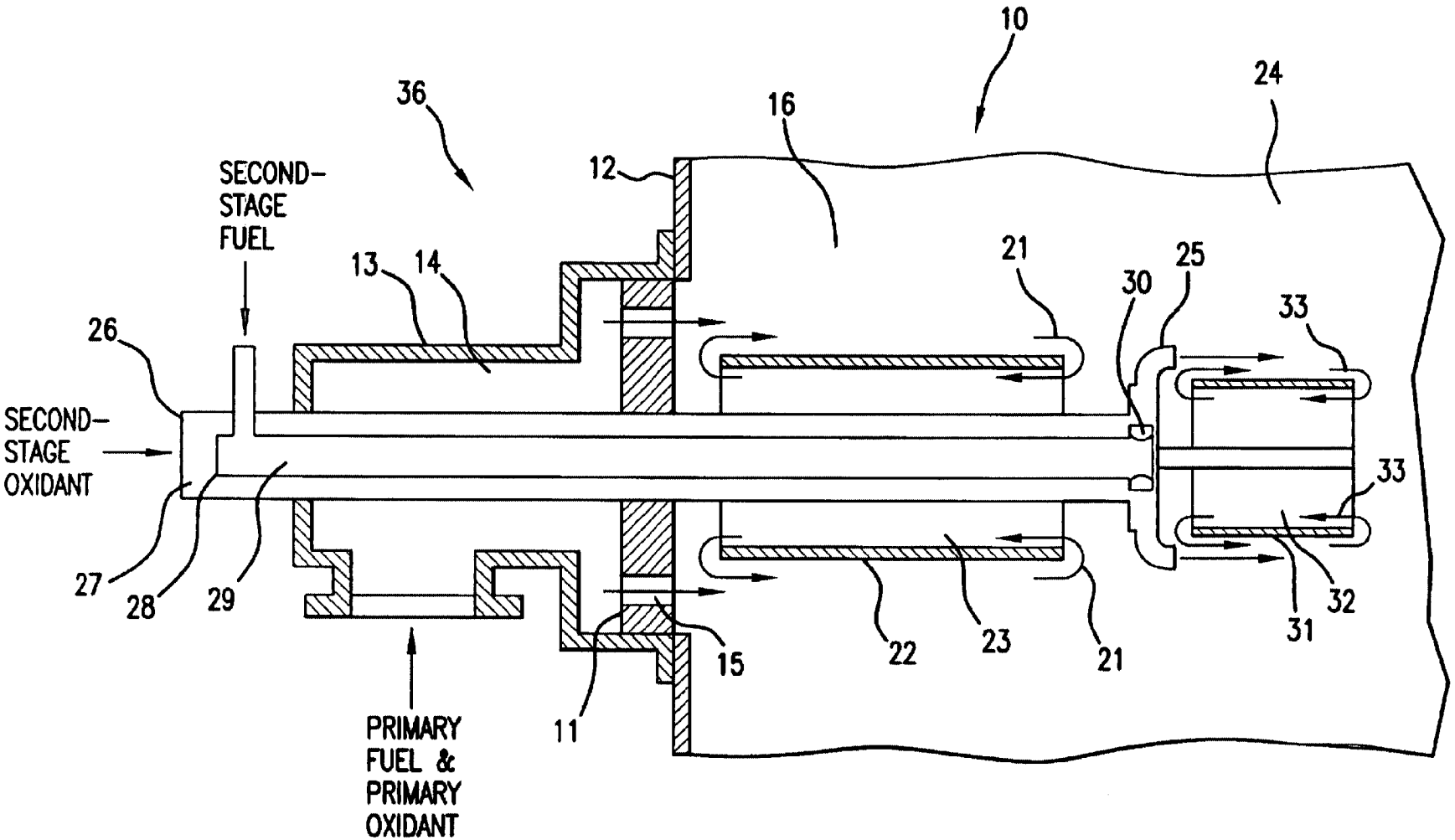
FIG. 3 is a partial cross-sectional lateral view of a combustion apparatus in accordance with yet another embodiment of this invention in which a secondary recirculation means is provided for recirculating secondary combustion products from the downstream region of the secondary combustion zone to an upstream region of the secondary combustion zone, which means can also be employed in combination with the embodiment shown in FIG. 1.

Yet another embodiment of the combustion apparatus of this invention is shown in FIG. 3 in which multi-stage fuel/multi-stage oxidant burner 36, substantially as shown in FIG. 2, further comprises secondary recirculation wall or sleeve 31, preferably in the form of a hollow cylinder, disposed downstream of second-stage nozzles 25 and substantially parallel to the central axis of multi-stage fuel/multi-stage oxidant burner 36. Although not wishing to be bound by any single theory or explanation, it is believed that, as a result of negative pressure generated at the upstream end of secondary combustion zone 24 by the kinetic energy provided by the introduction of the second-stage fuel/second-stage oxidant mixture through second-stage nozzles 25, a portion of the secondary combustion products entering the downstream end of secondary combustion zone 24 are recirculated through secondary annulus 32, as indicated by arrows 33, and reintroduced through the upstream region of secondary combustion zone 24 into secondary combustion zone 24. It will be apparent to those skilled in the art that the improvements shown in FIG. 3 may be applied to the embodiment of the combustion apparatus of this invention shown in FIG. 1.

Figure 4:
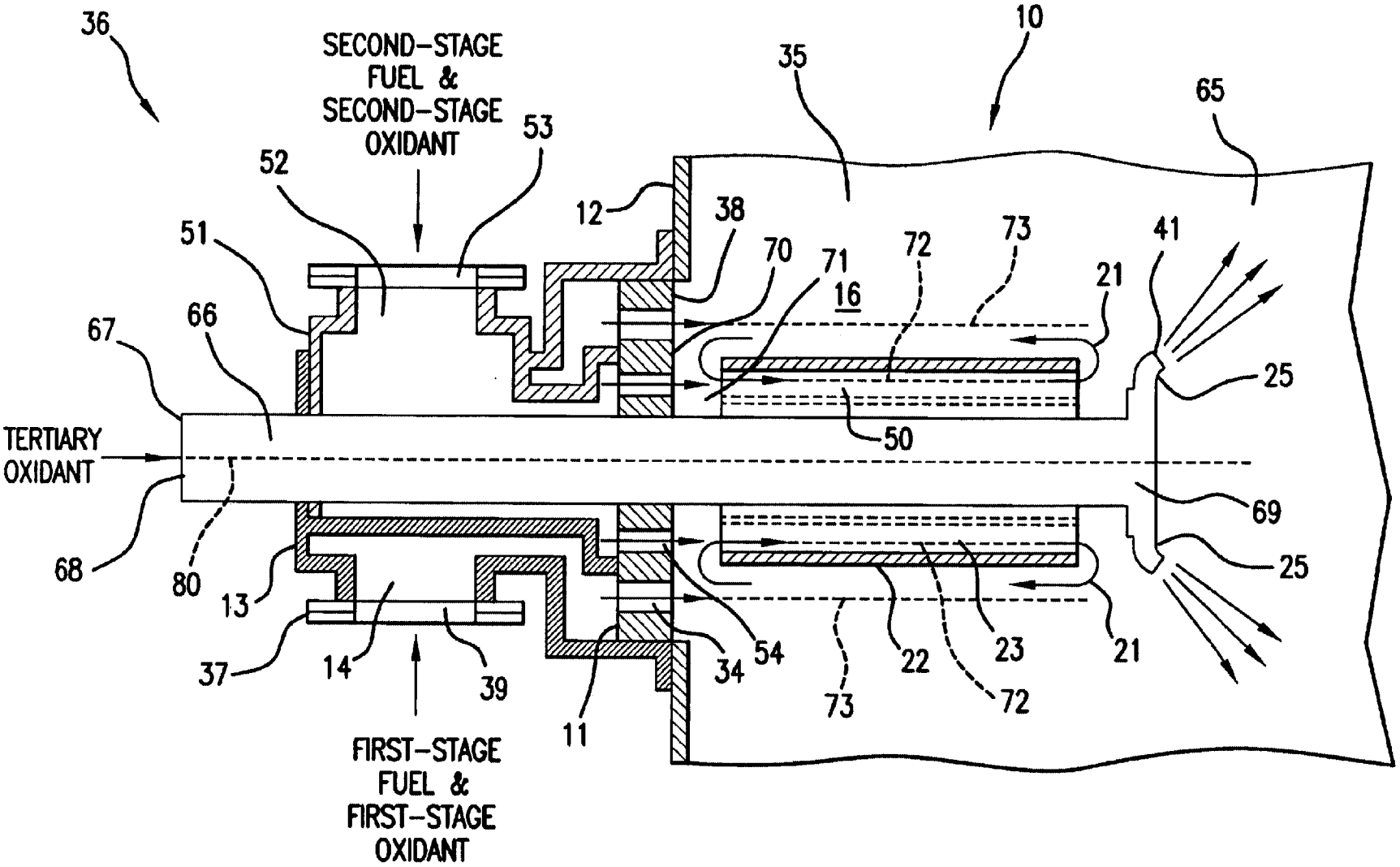
FIG. 4 is a partial cross-sectional lateral view of a combustion apparatus in accordance with yet a further embodiment of this invention whereby fuel is introduced in two stages and oxidant is introduced in three stages into a combustion chamber.

FIG. 4 shows yet a further embodiment of this invention which is particularly suitable for use in applications such as steel manufacturing in which relatively low Btu fuel gases such as blast furnace gas and coke oven gas are employed as first stage and second stage fuels. It should be noted that reference to the use of this invention in steel manufacturing applications is in no way intended to limit the scope of applications in which the invention can be employed.

As shown in FIG. 4, the combustion apparatus in accordance with one embodiment of this invention comprises a second stage fuel plenum chamber wall 51 enclosing a second stage fuel plenum chamber 52 in first-stage plenum chamber 14. End wall 11 forms at least one second stage fuel nozzle opening 54 providing fluid communication between second stage fuel plenum chamber 52 and combustion chamber 35. Fuel gases injected through nozzle openings 34 and 54 are premixed with oxidant prior to injection into combustion chamber 35, thereby, in addition to providing first stage and second stage fuel, also providing first stage and second stage oxidant. Third-stage plenum chamber wall 67 encloses third-stage plenum chamber 66, at least a portion of which is disposed within second-stage fuel plenum chamber 52, and comprises third-stage oxidant inlet end 68 and third-stage oxidant outlet end 69 through which tertiary oxidant is introduced into combustion chamber 35.

In accordance with the embodiment shown in FIG. 4, combustion chamber 35 comprises primary combustion zone 16 and secondary combustion zone 50. As shown, secondary combustion zone 50 is formed within recirculation annulus 23 formed between recirculation wall 22 and third-stage plenum chamber wall 67 whereby products of combustion are recirculated from a downstream end of recirculation wall 22 to an upstream end of recirculation wall 22 as indicated by arrows 21. Combustion chamber 35 further comprises tertiary combustion zone 65 disposed downstream of third-stage outlet end 69 of third-stage plenum chamber 66.

In accordance with one embodiment of this invention, end wall 11 forms a second stage array of second-stage fuel nozzle openings 54 disposed around a central axis 80 of third-stage plenum chamber 66, which central axis is disposed substantially perpendicular to end wall 11, and a first-stage array of first stage fuel nozzle openings 34 concentrically disposed around said second-stage array of second-stage fuel nozzle openings 54, thereby forming an annular ring 70 between the first-stage array and the second stage array. In accordance with one embodiment of this invention, recirculation wall 22 is disposed within an area 71 bounded by a longitudinal axis 72 of each of second-stage fuel nozzle openings 54 shown in phantom in FIG. 4. In this embodiment, both first-stage fuel and second-stage fuel are introduced into combustion chamber 35 along the outside of recirculation wall 22. In accordance with another embodiment of this invention, recirculation wall 22 is disposed within an annular space formed between a boundary formed by the longitudinal axis 72 of each of the second-stage fuel nozzle openings 54 and the longitudinal axis 73 of each of the first-stage fuel nozzle openings 34. In this embodiment, second-stage fuel is introduced into recirculation annulus 23 and first-stage fuel is introduced into combustion chamber 35 along the outside of recirculation wall 22.

In accordance with one embodiment of the combustion method of this invention, a first-stage fuel and a first-stage oxidant are introduced into a combustion chamber and ignited, forming a primary combustion zone comprising first-stage combustion products. At least about 5% of a total heat output produced by the combustion of the first-stage fuel and first-stage oxidant is removed from the primary combustion zone, forming cooled first-stage combustion products. A portion of the cooled first-stage combustion products are recirculated from a downstream region of the primary combustion zone to an upstream region of the primary combustion zone. A second-stage fuel is introduced into the combustion chamber downstream of the primary combustion zone, forming a secondary combustion zone and igniting the second-stage fuel, forming second-stage combustion products. At least about 5% of the heat generated by the combustion of the second-stage fuel is removed from the secondary combustion zone. In accordance with one embodiment of the method of this invention, the first-stage fuel comprises more than a stoichiometric requirement for complete combustion of the first-stage fuel. In accordance with one embodiment of this invention, a second-stage oxidant is introduced into the secondary combustion zone, preferably in an amount comprising less than the stoichiometric requirement for complete combustion of the second-stage fuel. In accordance with one particularly preferred embodiment of this invention, the amount of second-stage fuel is less than the amount of first-stage fuel. The preferred ratio of second-stage fuel to first-stage fuel is in the range of about 0.05 to 0.33 (based on heat content). The preferred stoichiometric air- to-fuel ratio in the first stage is in the range of about 1.20 to 1.40 and the stoichiometric air-to-fuel ratio in the second stage is preferably in the range of about 0.00 to 0.70. These ratios are interrelated such that the overall stoichiometric air-to-fuel ratio is in the preferred range of about 1.05 to 1.25, although higher or lower ratios may be employed if desired. In accordance with one embodiment of this invention, at least one of the first-stage oxidant and the second-stage oxidant is preheated.

Fuels that may be used in the method of this invention include, but are not limited to, natural gas, propane, hydrogen, producer gas, refinery gas, synthesis gas, coke oven gas, blast furnace gas, and hydrocarbon liquids. In accordance with one particularly preferred embodiment of this invention, the fuel is natural gas. Suitable oxidants for use in the method of this invention are air, oxygen-enriched air, and oxygen. In accordance with one preferred embodiment of this invention, recirculated flue gases are mixed with either the first-stage oxidant or the second-stage oxidant.

Laboratory test data, shown in Table 1, show that application of fuel staging in accordance with the method and apparatus of this invention results in lower $NO_x$ and CO per unit volume of flue gas than with a similar burner employing only air staging. In addition, cooling of the primary zone further decreases emissions.

TABLE 1

| Test No. | Staging type | Primary zone cooling | Firing rate, MM Btu/h | Overall Stoichiometric Ratio | CO, vppm* | $NO_x$ vppm* |
|---|---|---|---|---|---|---|
| 1 | Air only | No | 4.0 | 1.09 | 24.9 | 12.7 |
| 2 | Fuel/air | No | 4.0 | 1.08 | 2.4 | 8.2 |
| 3 | Fuel/air | Yes | 4.0 | 1.08 | 0.1 | 6.7 |

*Corrected to 3% $O_2$

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of this invention.

We claim:

1. A combustion apparatus comprising:

at least one combustion chamber wall forming at least one burner opening and enclosing a combustion chamber; and at least one multi-stage fuel/multi-stage oxidant burner having a fuel and oxidant inlet end and a fuel and oxidant outlet end attached to said at least one combustion chamber wall, at least a portion of said fuel and oxidant outlet end extending through said at least one burner opening.

2. An apparatus in accordance with claim 1, wherein said at least one multi-stage fuel/multi-stage oxidant burner comprises a first-stage plenum chamber wall enclosing a first-stage plenum chamber and forming a first-stage inlet for a first-stage fuel and a first-stage oxidant and a first-stage outlet for said first-stage fuel and said first-stage oxidant, said first-stage outlet in fluid communication with said at least one burner opening, an end wall disposed within said first-stage outlet having a periphery in contact with said first-stage plenum chamber wall and forming at least one first-stage nozzle opening and at least one second-stage nozzle opening, said at least one first-stage nozzle opening providing a fluid communication between said combustion chamber and said first-stage plenum chamber, and a second-stage plenum chamber wall enclosing a second-stage plenum and forming a second-stage inlet for at least one of a second-stage fuel and a second-stage oxidant and a second-stage outlet for at least one of said second-stage fuel and said second-stage oxidant, at least a portion of said second-stage plenum chamber disposed within said first-stage plenum chamber and extending through said end wall, thereby providing fluid communication between said second-stage outlet and said combustion chamber.

3. An apparatus in accordance with claim 2 further comprising at least one second-stage cooling jacket wall forming a cooling jacket around and in contact with at least a portion of an outer surface of said second-stage plenum chamber wall.

4. An apparatus in accordance with claim 2, wherein said combustion chamber comprises a primary combustion zone and a secondary combustion zone disposed downstream of said primary combustion zone, and said at least one multi-stage fuel/multi-stage oxidant burner comprises recirculation means for recirculating products of combustion from a downstream region of said primary combustion zone to an upstream region of said primary combustion zone.

5. An apparatus in accordance with claim 4, wherein a portion of said second-stage plenum chamber extends into said combustion chamber and said recirculation means comprises a recirculation wall surrounding at least a portion of said second-stage plenum chamber extending into said combustion chamber, forming a recirculation annulus between said second-stage plenum chamber wall and said recirculation wall.

6. An apparatus in accordance with claim 4, wherein said second-stage outlet is disposed within said secondary combustion zone.

7. An apparatus in accordance with claim 6, wherein said second-stage outlet comprises a plurality of second-stage nozzles disposed in an array around a central axis of said second-stage plenum chamber, said central axis being disposed perpendicular to said end wall.

8. An apparatus in accordance with claim 7 further comprising a secondary recirculation wall disposed downstream of said plurality of second-stage nozzles.

9. An apparatus in accordance with claim 8, wherein said secondary recirculation wall is in a form of a hollow cylinder having a longitudinal axis substantially parallel to said central axis.

10. An apparatus in accordance with claim 2, wherein said second-stage plenum chamber comprises a second-stage oxidant plenum chamber wall enclosing a second-stage oxidant plenum chamber having a second-stage oxidant inlet end and a second-stage oxidant outlet end and a second-stage fuel plenum chamber wall disposed within said second-stage oxidant plenum chamber and enclosing a second-stage fuel plenum chamber having a second-stage fuel inlet end and a second-stage fuel outlet end.

11. An apparatus in accordance with claim 10, wherein a plurality of second-stage oxidant nozzles are connected to said second-stage oxidant outlet end and a plurality of second-stage fuel nozzles are connected to said second-stage fuel outlet end.

12. An apparatus in accordance with claim 11 further comprising a first-stage recirculation means for recirculating first-stage combustion products from a downstream region of a primary combustion zone to an upstream region of said primary combustion zone disposed in said combustion chamber surrounding said second-stage plenum chamber upstream of said second-stage oxidant nozzles and a second-stage recirculation means for recirculating second-stage combustion products from a downstream region of a secondary combustion zone to an upstream region of said secondary combustion zone disposed in said combustion chamber downstream of said primary combustion zone disposed downstream of said second-stage oxidant nozzles.

13. An apparatus in accordance with claim 12, wherein each of said first-stage recirculation means and said second-stage recirculation means comprises a hollow cylinder having a longitudinal axis substantially parallel to a central axis of said second-stage plenum chamber.

14. An apparatus in accordance with claim 2 further comprising a second-stage fuel plenum chamber wall enclosing a second-stage fuel plenum chamber, said end wall forming at least one second-stage fuel nozzle opening providing a fluid communication between said combustion chamber and said second-stage fuel plenum chamber.

15. An apparatus in accordance with claim 14, wherein said combustion chamber comprises a primary combustion zone and a secondary combustion zone disposed one of downstream of and inside of said primary combustion zone, and said at least one multi-stage fuel/multi-stage oxidant burner comprises recirculation means for recirculating products of combustion from a downstream region of said primary combustion zone to an upstream region of said primary combustion zone.

16. An apparatus in accordance with claim 15, wherein a portion of said second-stage plenum chamber extends into said combustion chamber and said recirculation means comprises a recirculation wall surrounding at least a portion of said second-stage plenum chamber extending into said combustion chamber, forming a recirculation annulus between said second-stage plenum chamber wall and said recirculation wall.

17. An apparatus in accordance with claim 16, wherein said end wall forms a first-stage array of said first-stage nozzle openings disposed around a central axis of said second-stage plenum chamber and a second-stage array of said second-stage fuel nozzles disposed concentrically around said first-stage array of said first-stage nozzle openings, thereby forming an annular ring between said first-stage array and said second-stage array, said central axis being disposed perpendicular to said at least one end wall.

18. An apparatus in accordance with claim 17, wherein said recirculation wall is disposed within an area bounded by a longitudinal axis of each of said first-stage nozzle openings.

19. An apparatus in accordance with claim 17, wherein said recirculation wall is disposed within an annular space formed between a boundary formed by a longitudinal axis of each of said first-stage nozzle openings and a longitudinal axis of each of said second-stage nozzle openings.

20. An apparatus in accordance with claim 15, wherein said combustion chamber forms a tertiary combustion zone downstream of said secondary combustion zone.

* * * * *